US005758989A

United States Patent [19]

Snowberger

[11] Patent Number: 5,758,989

[45] Date of Patent: Jun. 2, 1998

[54] LINEAR ACTION HURTER

[75] Inventor: Ralph B. Snowberger, Louisville, Ky.

[73] Assignee: The United States of America as represented by the Secretary of the Army, Washington, D.C.

[21] Appl. No.: 496,113

[22] Filed: Jun. 28, 1995

[51] Int. Cl.[6] ..... E02B 3/00; E02B 7/20; E02B 7/40

[52] U.S. Cl. ..... 405/80; 405/87; 405/92; 405/100; 405/101; 405/102

[58] Field of Search ..... 405/80, 87, 92, 405/100, 101, 102

[56] References Cited

U.S. PATENT DOCUMENTS

| | | | |
|---|---|---|---|
| 398,088 | 2/1889 | Scott | 405/102 |
| 1,624,581 | 4/1927 | Aubert . | |
| 3,718,002 | 2/1973 | Aubert | 61/22 |
| 5,178,490 | 1/1993 | Snowberger | 405/102 |
| 5,310,284 | 5/1994 | Snowberger | 405/102 |
| 5,433,555 | 7/1995 | Parizot | 405/100 |

FOREIGN PATENT DOCUMENTS

| | | | |
|---|---|---|---|
| 1210783 | 3/1960 | France | 61/26 |

*Primary Examiner*—Tamara L. Graysay
*Assistant Examiner*—Tara L. Mayo
*Attorney, Agent, or Firm*—Luther A. Marsh

[57] ABSTRACT

A hurter for use in conjunction with a wicket dam prop at a downstream side of a wicket, the hurter comprising a block having therein on an upper surface thereof a bearing for receiving a free end of the prop, a ramp disposed downstream of the block on a base plate and inclined from the base plate to a top surface of the block and adapted to support the free end of the prop, a first trough wall on a first side of the ramp and the block hingedly connected to the base plate, a cover portion of the first trough wall extending over a first portion of the block, and a second trough wall on a second side of the ramp and the block hingedly connected to the base plate, a cover portion of the second trough wall extending over a second portion of the block, the first and second trough wall cover portions being engageable by the prop as the prop moves up the ramp, to cause the first and second trough walls to pivot away from each other to permit the prop to pass between the cover portions and into the bearing.

6 Claims, 7 Drawing Sheets

LINEAR ACTION HURTER

BACKGROUND OF THE INVENTION

1. Field of the Invention

This invention relates to flood control devices and is directed more particularly to a hurter for use in conjunction with a wicket, which may be raised in a body of water to establish a barrier to water flow, and lowered to permit unimpeded flow of water, and a prop for holding the wicket in a raised position.

2. Description of the Prior Art

Wicket assemblies are known wherein there is provided a wicket which may be raised to act as a dam, to prevent or control the flow of water, wicket raising means, prop means for retaining the wicket in its raised position, and a hurter having a bearing, or recess, therein for receiving and retaining one end of the prop. Such assemblies are shown and described in U.S. Pat. No. 5,178,490, issued Jan. 12, 1993, in the names of Ralph B. Snowberger, et al, and in U.S. Pat. No. 5,310,284, issued May 10, 1994, in the name of Ralph B. Snowberger.

In fast-moving and/or turbulent waters, the free end of the prop has, on occasion, been lifted entirely clear of the hurter, permitting the free end of the prop to move downstream unrestrained and unconfined. Before the wicket can be raised again and held by the prop, the prop free end must be placed back in the hurter, requiring underwater operations which are both time-consuming and expensive.

There is thus a need for a more secure hurter, having facility for retaining the prop free end within the hurter, even when turbulent waters cause the prop free end to be raised clear of the hurter block bearing.

SUMMARY OF THE INVENTION

An object of the invention is, therefore, to provide a hurter for use in combination with a wicket prop in a wicket assembly, the hurter being adapted to securely retain the free end of the prop when the wicket is in a raised position.

A further object of the invention is to provide such a hurter adapted to release the prop when it is desired to lower the wicket and to provide a support for the free end of the prop as the prop moves in response to lowering of the wicket.

A still further object is to provide a hurter adapted to retain the prop free end within the confines of the hurter when the free end is dislodged from the bearing.

With the above and other objects in view, as will hereinafter appear, a feature of the present invention is the provision of a hurter for use in conjunction with a wicket dam prop at a downstream side of a wicket, the hurter comprising a block having therein on an upper surface thereof a bearing for receiving the free end of the prop, a ramp disposed downstream of the block on a base plate and inclined from the base plate to a top surface of the block and adapted to support the free end of the prop, a first trough wall on a first side of the ramp and the block hingedly connected to the base plate, a cover portion of the first trough wall extending over a first portion of the block, and a second trough wall on a second side of the ramp and the block hingedly connected to the base plate, a cover portion of the second trough wall extending over a second portion of the block, the first and second trough wall cover portions being engageable by the prop as the prop moves up the ramp, to cause the first and second trough walls to pivot away from each other to permit the prop to pass between the cover portions and into the bearing.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENT

Figure 1:
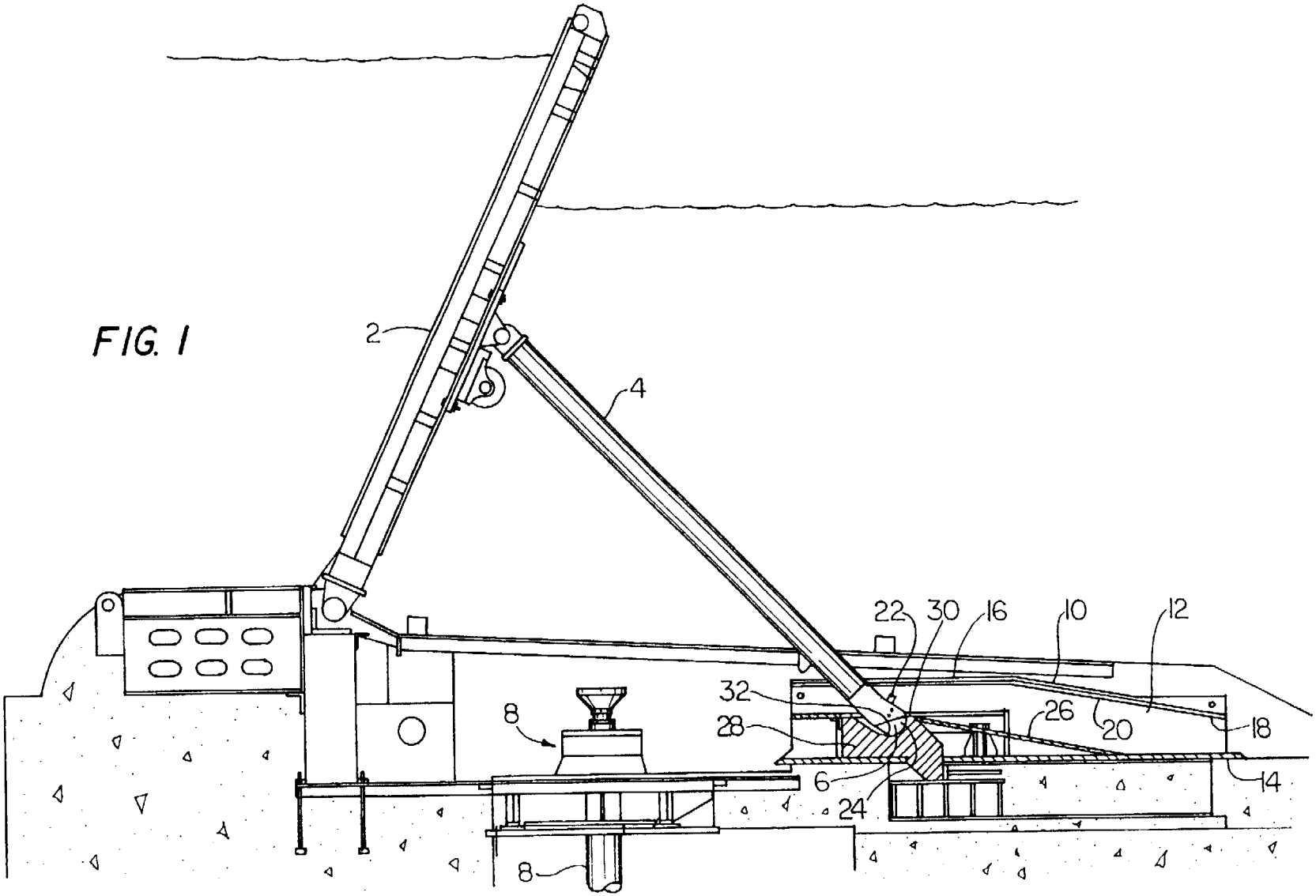
FIG. 1 is a generally side elevational view of a wicket dam assembly, including a hurter shown in centerline section, and illustrative of an embodiment of the invention.

Referring to FIG. 1, it will be seen that a wicket assembly of the type in which a hurter is a component, includes a wicket 2, which may be raised to stop or control water flow, or to define a water body boundry as, for example, a boundary between an upper pool level and a lower pool level.

Pivotally connected to the wicket 2 is a prop 4 having a free end 6. A hydraulic lifting mechanism 8 is operative to engage the wicket 2 and move the wicket 2 upwardly. The lifting mechanism 8 is pivotally mounted so as to apply pressure to the underside of the wicket in a wicket raising operation. A lifting mechanism of the type contemplated herein is shown and described in the aforementioned U.S. Pat. No. 5,178,490. A prop of the type contemplated herein is shown and described in the aforementioned U.S. Pat. No. 5,310,284.

Figure 3:
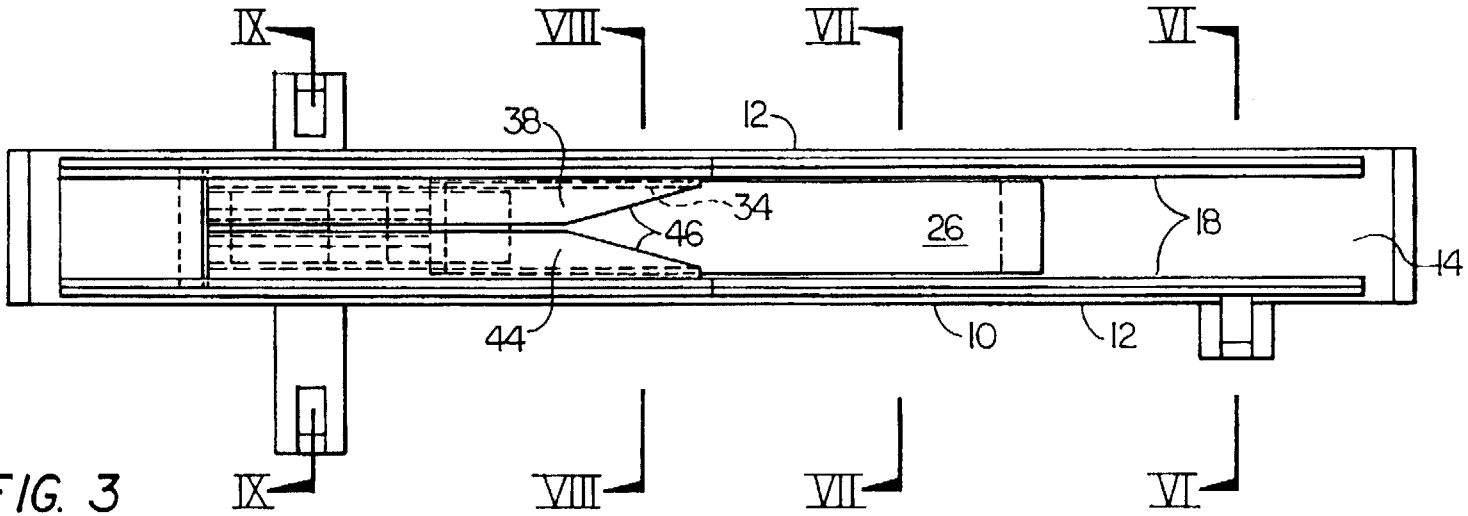
FIG. 3 is a top plan view of the hurter of FIG. 1.
Figure 4:
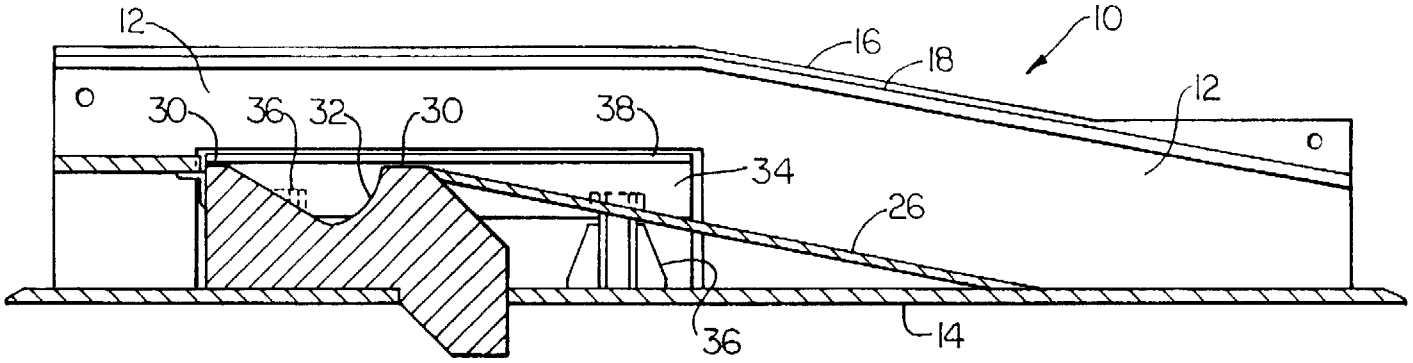
FIG. 4 is an enlarged sectional view of the hurter of FIG. 1.
Figure 5:
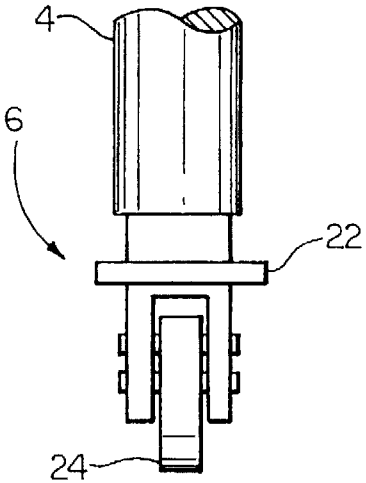
FIG. 5 is a front view of a free end portion of a prop member of the assembly of FIG. 1.
Figure 6:
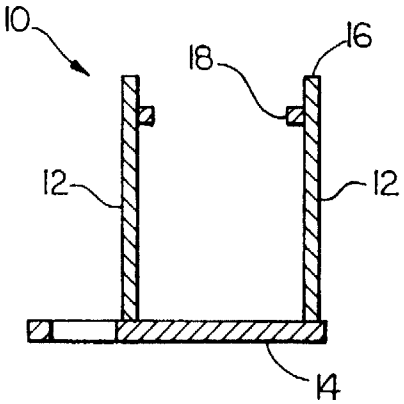
FIG. 6 is a sectional view of the hurter of FIG. 3 taken along line VI—VI of FIG. 3.

Referring to FIGS. 1–4 and 6–9, there is shown one form of an improved hurter 10 illustrative of an embodiment of the invention. As may be seen in FIGS. 2–4, the hurter 10 includes frame walls 12 extending substantially along the length of the hurter. The frame walls 12 extend upwardly from a base plate 14. Proximate an upper edge 16 of each of the frame walls 12 extends a rail 18 which extends lengthwise of the frame wall and inboard from an inside surface of the frame wall. An undersurface 20 of each of the rails 18 is adapted to confine the guide bar means 22 (FIG. 5) fixed on the prop 4 at the free end portion 6 thereof, as will be further described hereinbelow. Referring still to FIG. 5, it will be seen that the free end 6 of the prop 4 is provided with a bearing tip 24.

Returning to FIGS. 2–4, it will be seen that between the frame walls 12 and on the base plate 14 there is disposed a ramp 26 and a block 28 having on an upper surface 30 thereof a bearing 32 (FIG. 4), which is adapted to receive the prop wear member 24 (FIG. 1). The ramp 26 is disposed downstream, rightwardly as viewed in FIGS. 1–4, of the block 28 on the base plate 14 and inclines from the base plate 14 to the top surface 30 of the block 28. The ramp 26 is adapted to support the prop free end 6 as the prop free end is dragged up the ramp 26 in a wicket raising operation, as will be further described hereinbelow.

Figure 2:
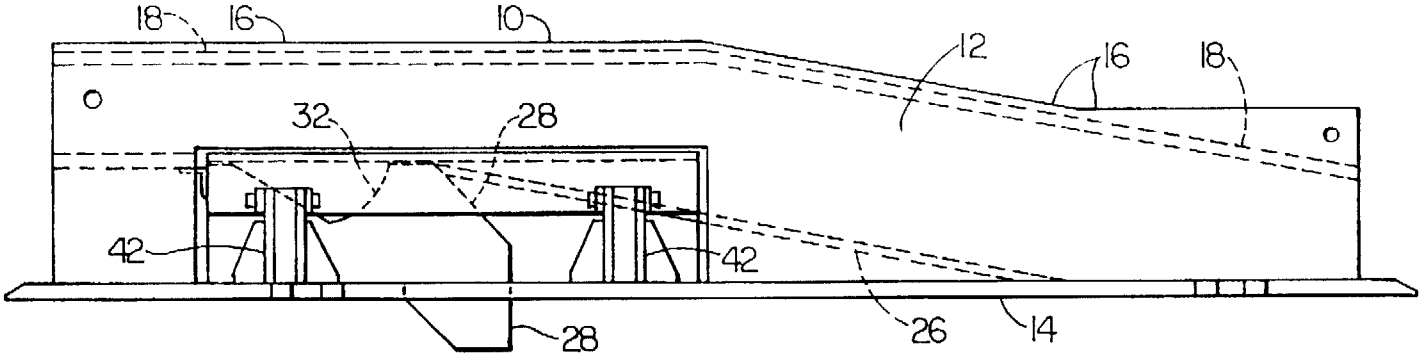
FIG. 2 is a side elevational view of the hurter of FIG. 1.
Figure 9:
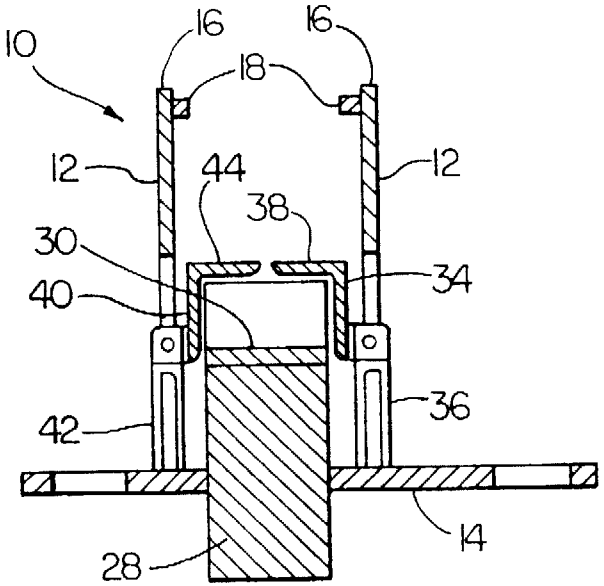
FIG. 9 is a sectional view of the hurter of FIG. 3, taken along line IX—IX of FIG. 3.
Figure 8:
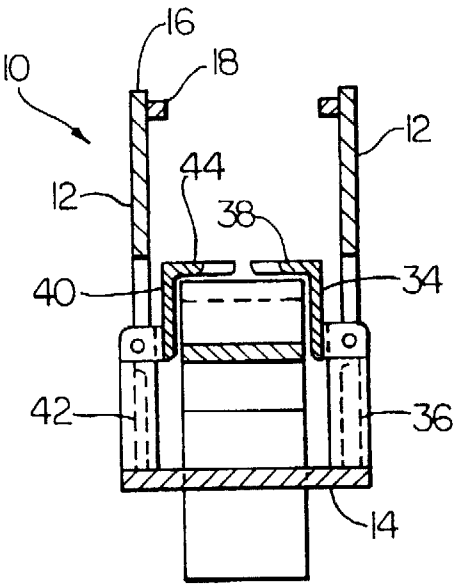
FIG. 8 is a sectional view of the hurter of FIG. 3, taken along line VIII—VIII of FIG. 3.
Figure 7:
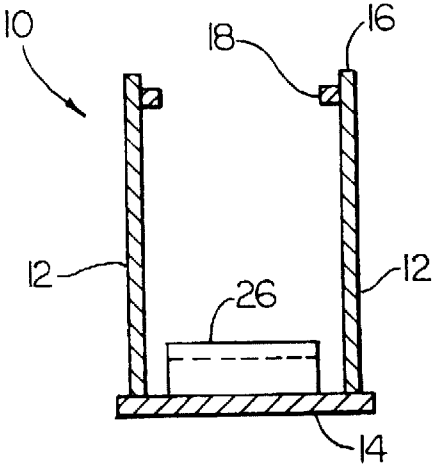
FIG. 7 is a sectional view of the hurter of FIG. 3, taken along line VII—VII of FIG. 3.

Inboard of one of the frame walls 12 is disposed a first trough wall 34 on a first side of the ramp 26 and the block 28. The first trough wall 34 is connected to hinge means 36 extending upwardly from the base plate 14 (FIGS. 4, 8 and 9). A cover portion 38 of the first trough wall 34 extends over a first portion of the block 28. Inboard of the other of the frame walls 12 is disposed a second trough wall 40 on a second side of the ramp 26 and the block 28. The second trough wall 40 is connected to hinge means 42 extending upwardly from the base plate 14 (FIGS. 2, 8 and 9). A cover portion 44 of the second trough wall 40 extends over a second portion of the block 28.

Referring to FIG. 3, it will be seen that opposed rearward edges 46 of the cover portions 38, 44 slant in a converging fashion in an upstream direction. Thus, in movement of the free end 6 of the prop 4 up the ramp 26, the prop 4 is guided by the edges 46 to an area between the cover portions 38, 44 of the first and second trough walls 34, 40.

Figure 11:
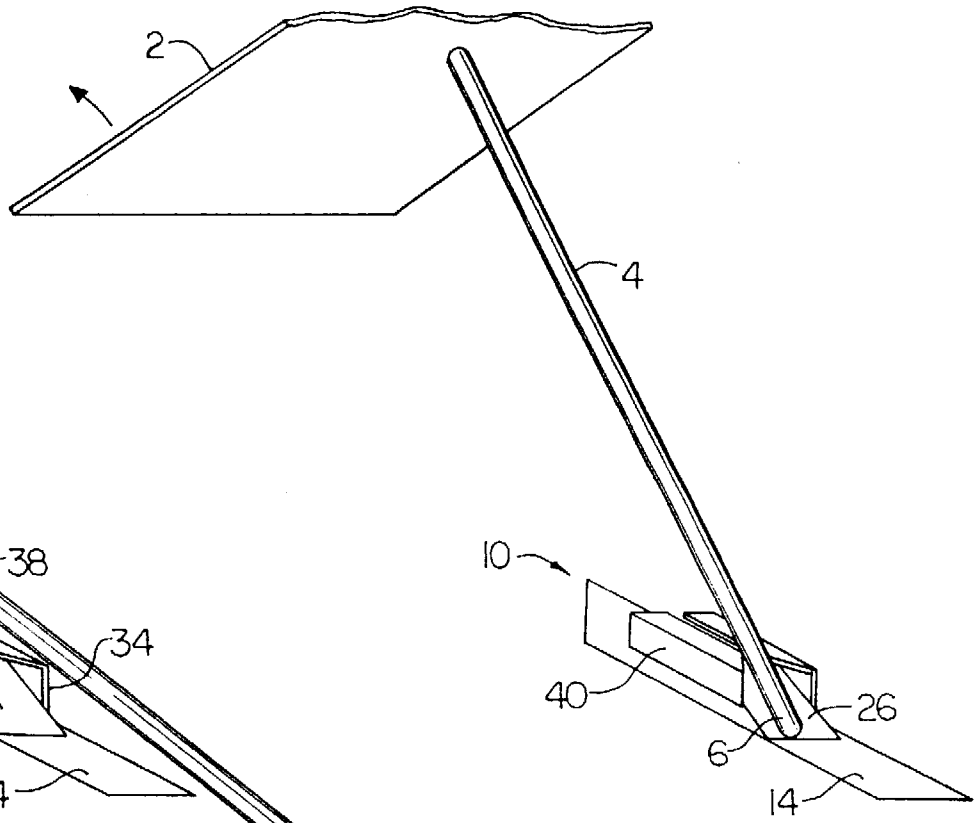
FIGS. 10–14 are perspective diagrammatic views, illustrative of the hurter and wicket assembly of FIG. 1, in operation.
Figure 12:
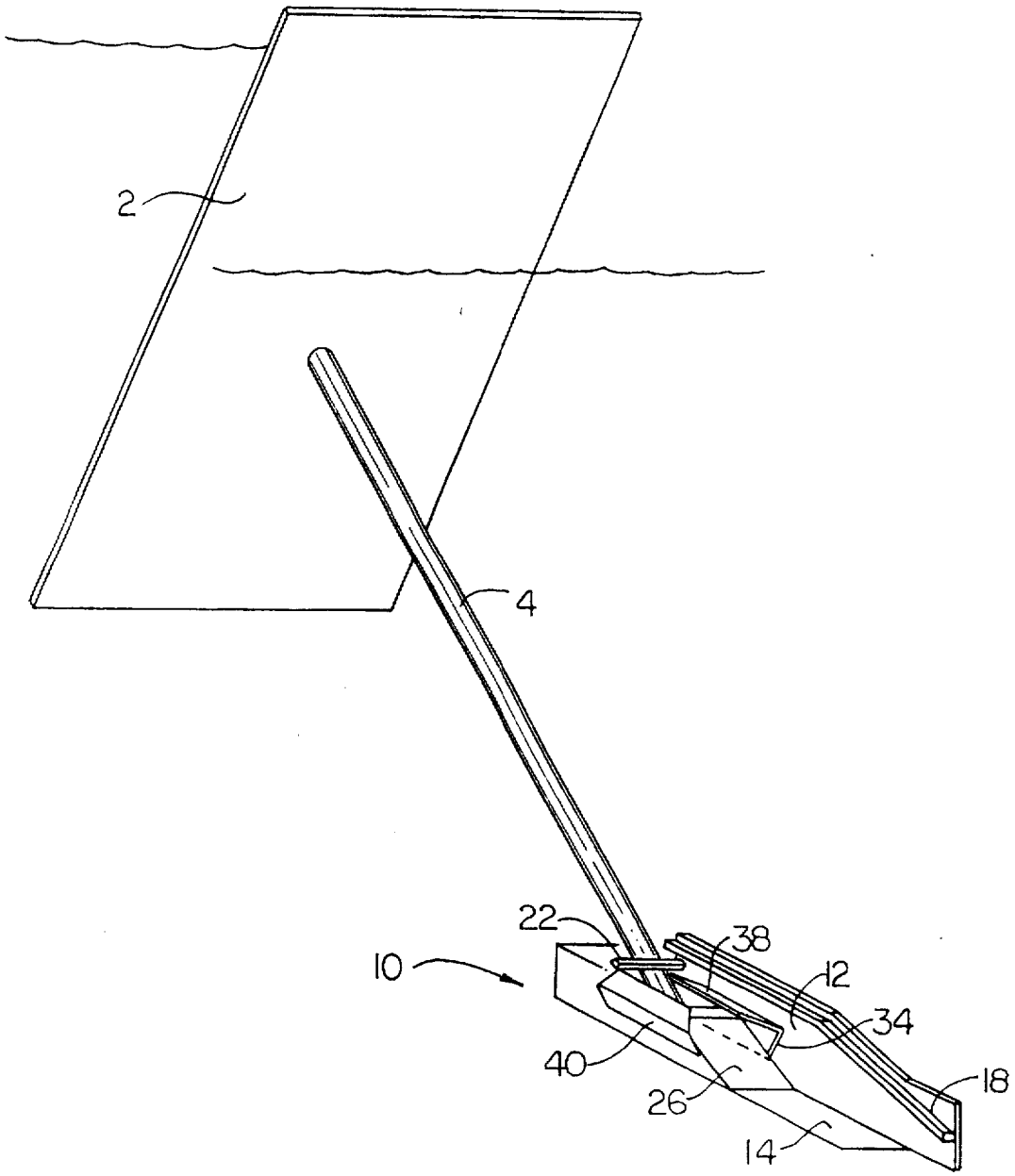

In operation, when it is desired to raise the wicket 2 from its lowered position (FIG. 10), the lifting mechanism 8 (FIG. 1) is extended to engage the underside of the wicket 2 and push the wicket upwardly. As the wicket 2 rises, the prop 4, which is pivotally connected to the wicket, is dragged along toward the base plate 14. In due course, the free end 6 of the prop 4 slides along the base plate 14 and up the ramp 26 (FIG. 11). The prop 4 engages the rearward edges 46 of the trough wall cover portions 38, 44 which are caused thereby to pivotally move away from each other (FIG. 12) to permit the prop 4 to pass therebetween and the bearing tip 24 at the free end 6 of the prop to enter the block bearing 32. The prop guide bar 22 is confined to the hurter assembly by the undersurfaces 20 of the rails 18, and once the free end 6 of the prop 4 is nestled in the bearing 32 (FIG. 1), the rails 18 prevent the lifting of the prop free end 6 clear of the hurter assembly. Thus, the prop is not dislodged from the hurter assembly by rough or turbulent waters.

Figure 10:
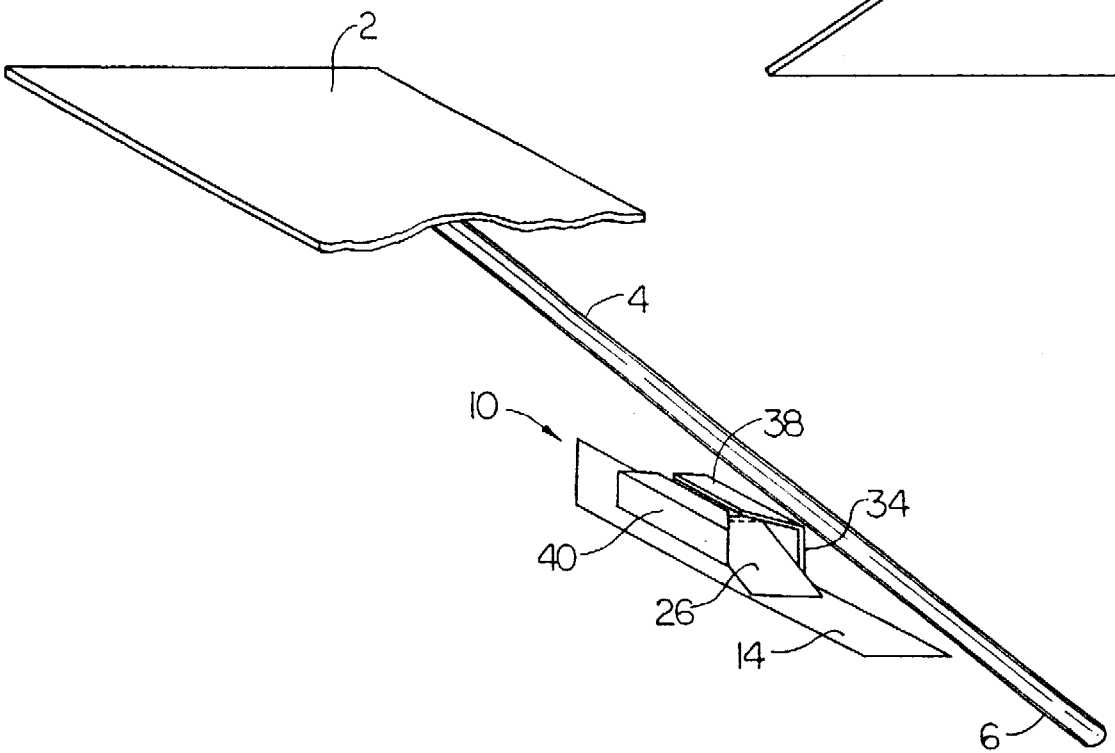
Figure 14:
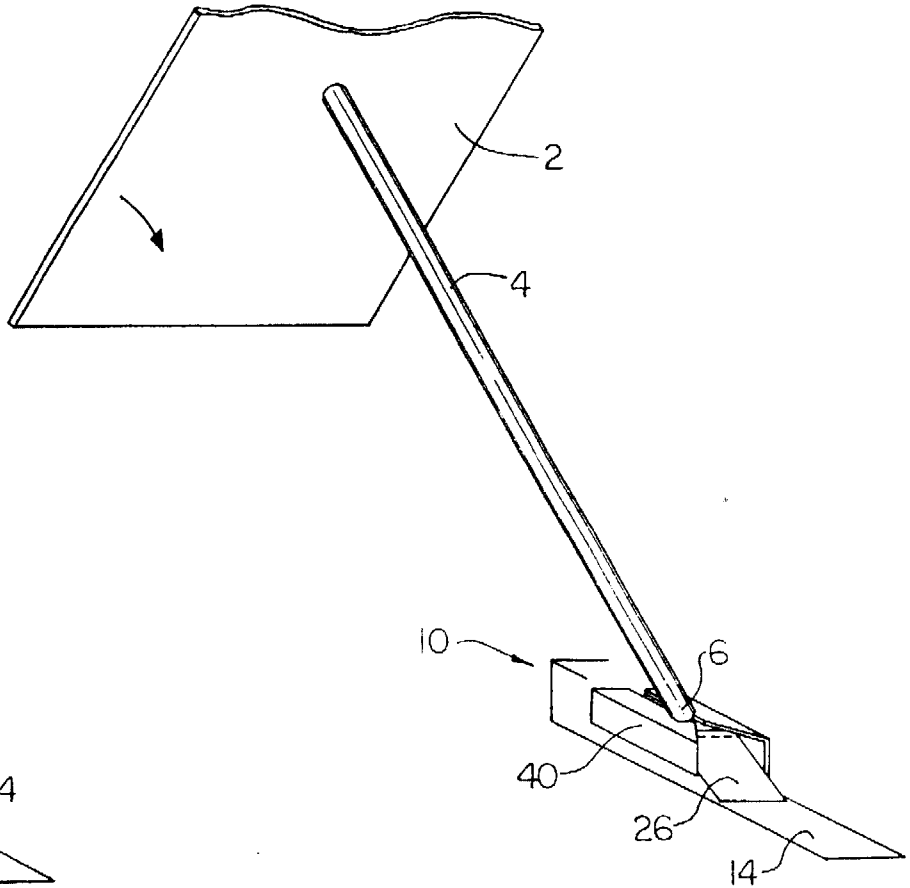
Figure 13:
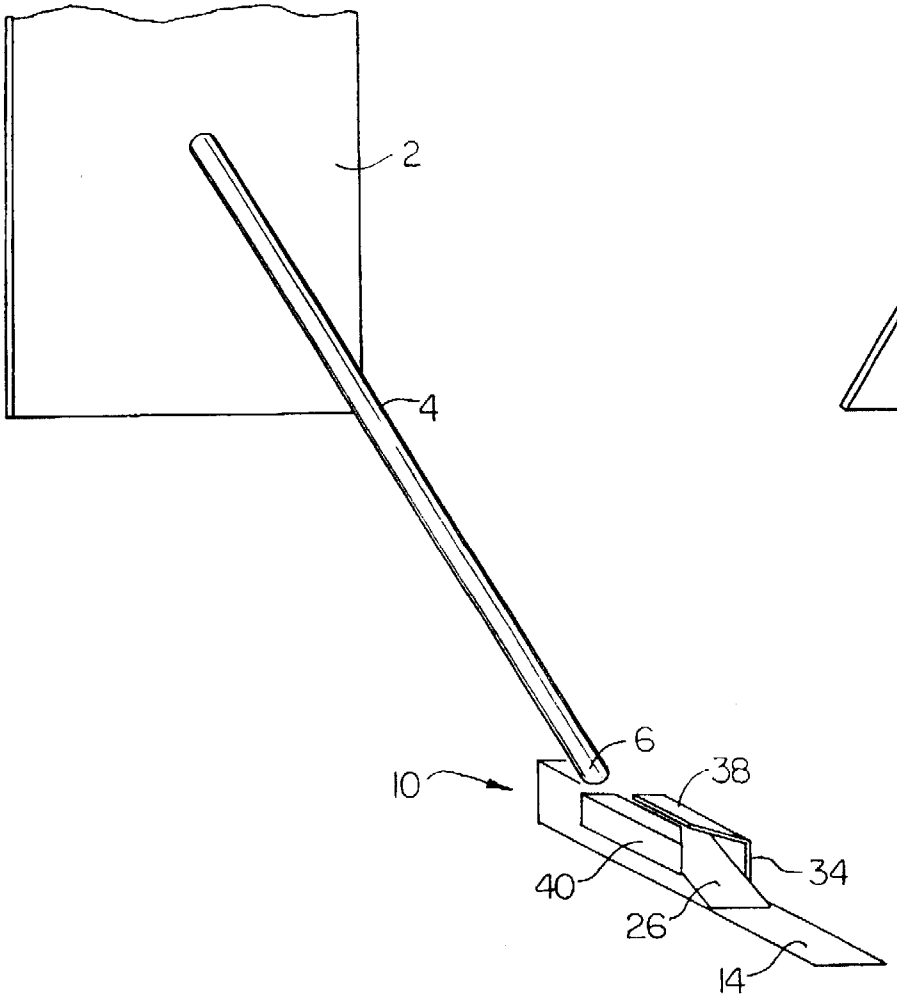

When it is desired to lower the wicket, the lifting mechanism 8 is again activated to raise the wicket (FIG. 13) beyond its normal raised position, causing the prop free end 6 to rise out of the bearing 32 and allowing the cover portions 38, 44 to close. The wicket 2 is then lowered, with the closed cover portions 38, 44 preventing the prop free end 6 from re-entering the bearing 32. The bearing tip 24 of the free end 6 of the prop 4 then slides rearwardly along the upper surfaces of the cover portions 38, 44, the ramp 26 and the base plate 14 (FIG. 14), as the wicket descends to its lowered position (FIG. 10).

In the event of the free end 6 of the prop 4 being dislodged from the block bearing 32, as by turbulent waters, the prop is confined by the rails 18 to the hurter, permitting immediate raising of the wicket 2 without having to effect underwater reassembly of the prop and hurter.

There is thus provided an improved hurter assembly having means for preventing escape of the prop from the hurter assembly.

It is to be understood that the present invention is by no means limited to the particular construction herein disclosed and/or shown in the drawings, but also comprises any modifications or equivalents within the scope of the claims.

Having thus described my invention, what I claim as new and desire to secure by Letters Patent of the United States is:

1. A hurter for use in conjunction with a wicket dam prop downstream of a wicket, said hurter comprising:

a block having therein on an upper surface thereof a bearing for receiving a free end of said prop;

a ramp disposed downstream of said block on a base plate and inclined from said base plate to a top surface of said block and adapted to support said free end of said prop;

a first trough wall on a first side of said ramp and said block and hingedly connected to said base plate, a cover portion of said first trough wall extending over a first portion of said block; and a second trough wall on a second side of said ramp and said block and hingedly connected to said base plate, a cover portion of said second trough wall extending over a second portion of said block;

said first and second trough wall cover portions being engageable by said prop as said prop free end moves up said ramp, to cause said first and second trough walls to pivot away from each other to permit said prop to pass between said cover portions and into said bearing.

2. The hurter in accordance with claim 1 wherein said hurter further comprises first and second frame walls provided with rails extending lengthwise thereof on inside surfaces of said frame walls, said rails being adapted to confine to said hurter a bar means fixed to said prop proximate said free end.

3. The hurter in accordance with claim 2 wherein opposed rearward edges of said cover portions respectively slant in a converging fashion from a downstream end of said walls toward an upstream end thereof, said rearward edges of said cover portions being adapted to be engaged by said prop during said movement of said prop up said ramp, said cover portions being pivoted about said hinge connections to lift upwardly in response to said engagement by said prop, to permit said prop to move between said cover portions along said hurter.

4. The hurter in accordance with claim 3 wherein said frame walls are disposed outboard of said trough walls and are plano-parallel with said trough walls when said trough walls are undisturbed.

5. The hurter in accordance with claim 3 wherein said bar means on said prop is disposed beneath said rails when said free end of said prop is lifted free of said bearing, whereby to confine said prop to said hurter.

6. The hurter in accordance with claim 3 wherein said trough walls are adapted to pivotally move toward each other when said prop is lifted clear of said trough walls, forming a surface on which said free end of said prop moves toward said ramp during lowering of said wicket.

* * * * *